US005620748A

United States Patent [19]

Birkhofer et al.

[11] Patent Number: 5,620,748

[45] Date of Patent: Apr. 15, 1997

[54] USE OF GRAFT POLYMERS FOR FATLIQUORING AND FILLING LEATHER AND FUR SKINS

[75] Inventors: Hermann Birkhofer; Peter Danisch, both of Ludwigshafen; Walter Denzinger, Speyer; Heinrich Hartmann, Limburgerhof; Michael Kneip, Frankenthal, all of Germany

[73] Assignee: BASF Aktiengesellschaft, Ludwigshafen, Germany

[21] Appl. No.: 193,135

[22] PCT Filed: Jul. 13, 1993

[86] PCT No.: PCT/EP93/01831

§ 371 Date: Mar. 3, 1994

§ 102(e) Date: Mar. 3, 1994

[87] PCT Pub. No.: WO94/02650

PCT Pub. Date: Feb. 3, 1994

[30] Foreign Application Priority Data

Jul. 24, 1992 [DE] Germany ..... 42 24 456.0

[51] Int. Cl.[6] ..... B05D 3/02

[52] U.S. Cl. ..... 427/389; 8/94.1 R; 8/94.14; 8/94.21; 8/94.22; 8/94.23; 252/8.57; 428/473

[58] Field of Search ..... 524/773; 525/285, 525/291, 301; 526/238.3, 317.1, 318, 318.2, 318.3, 318.4, 318.41; 554/26, 27, 25; 427/389; 428/473, 94.1 R, 94.14, 94.21, 94.22, 94.23; 252/8.57

[56] References Cited

U.S. PATENT DOCUMENTS

| | | | |
|---|---|---|---|
| 2,346,858 | 4/1944 | Mighton | 554/26 |
| 3,392,176 | 7/1968 | Tweet | 554/26 X |
| 3,408,319 | 10/1968 | Rau | 524/547 |
| 3,639,650 | 2/1972 | Cummings | 554/26 X |
| 3,873,584 | 3/1975 | Burke, Jr. et al. | 554/27 |
| 3,890,259 | 6/1975 | Montesissa et al. | 554/26 |
| 3,971,744 | 7/1976 | Hudecek et al. | 524/773 X |
| 4,087,396 | 5/1978 | Hudecek et al. | 524/773 |
| 4,090,991 | 5/1978 | Fukusaki et al. | 524/773 X |
| 4,289,667 | 9/1981 | Bush | 524/773 X |
| 4,375,521 | 3/1983 | Arnold | 524/773 X |
| 5,296,576 | 3/1994 | Hoefer et al. | 526/216 |

FOREIGN PATENT DOCUMENTS

| | | | |
|---|---|---|---|
| 476567 | 8/1951 | Canada | 524/773 |
| 0688182 | 6/1964 | Canada | 554/26 |
| 0024886 | 3/1981 | European Pat. Off. . | |
| 2463780 | 3/1981 | France | 524/773 |

*Primary Examiner*—Judy M. Reddick

*Attorney, Agent, or Firm*—Oblon, Spivak, McClelland, Maier & Neustadt, P.C.

[57] ABSTRACT

Soft leathers with a pleasant hand are obtained on fatliquoring and filling leather and fur skins with water-soluble or water-dispersible graft polymers of vegetable and animal oils, obtainable by radically initiated polymerization A) of a monomer or monomer mixture comprising (a) from 20 to 100% by weight of monoethylenically unsaturated carboxylic acids and/or monoethylenically unsaturated sulfonic acids and/or monoethylenically unsaturated phosphonic acids or their alkali metal, alkaline earth metal or ammonium salts, (b) from 0 to 80% by weight of other monoethylenically unsaturated monomers which are copolymerizable with the monomers (a), and (c) from 0 to 5% by weight of at least doubly ethylenically unconjugatedly unsaturated monomers in the presence of B) vegetable and/or animal oils in a weight ratio of A:B of (80–1):(20–99).

11 Claims, No Drawings

USE OF GRAFT POLYMERS FOR FATLIQUORING AND FILLING LEATHER AND FUR SKINS

Fatliquoring is an operation in leathermaking which has a crucial bearing on the quality of the product and which is especially important for very soft kinds of leather. To control the mechanical properties of leather such as softness, flexibility and suppleness it is common to employ aqueous fat emulsions (fat liquors) which are in general based on petrochemically produced or natural oils and fats and are rendered water-emulsifiable by partial sulfonation or by means of emulsifiers.

Disadvantages of products of this kind include not only incomplete liquor exhaustion, ease of extraction by solvents or water, the occurrence of migration phenomena and unsatisfactory fastness profiles but also that they are not very suitable for fatliquoring hydrophobicized leathers; this is because the high proportion of polar groups or emulsifiers has the effect of destroying the water-repellent properties of a hydrophobicized leather, so that water can be carried into the leather by the polar groups.

For instance, Patent Application P 42 05 839.2 describes polymeric fatliquoring agents based on esterified or amidated homo- or copolymers of monoethylenically unsaturated dicarboxylic anhydrides, which, depending on the degree of derivatization of the carboxyl groups and on the polarity of the monomers, can lead to a certain deterioration in the water-repellent properties of hydrophobicized leather. This reference also describes further background art.

It is an object of the present invention to provide improved agents for fatliquoring and filling leathers and fur skins which are free of the prior art disadvantages.

We have found that this object is achieved by using water-soluble or water-dispersible graft copolymers of vegetable and animal oils obtainable by radically initiated polymerization as claimed in claim 1.

Monomers (a) are for example monoethylenically unsaturated mono- and dicarboxylic acids having preferably from 3 to 12 carbon atoms in the molecule, such as acrylic acid, methacrylic acid, dimethylacrylic acid, ethylacrylic acid, allylacetic acid, vinylacetic acid, crotonic acid, maleic acid, fumaric acid, itaconic acid, citraconic acid or methylenemalonic acid and the corresponding anhydrides. Suitable sulfo-containing monomers are for example vinylsulfonic acid, allylsulfonic acid, methallylsulfonic acid, 3-sulfopropyl acrylate, 3-sulfopropyl methacrylate, styrenesulfonic acid and 2-acryl-amido-2-methylpropanesulfonic acid.

Monomers with phosphonic acid groups are for example vinylphosphonic acid, allylphosphonic acid, phosphonomethylated allylamine and acrylamido-2-methylpropanephosphonic acid. Preferred monomers of group (a) are acrylic acid, methacrylic acid and maleic acid. It can also be advantageous to use mixtures of monomers (a).

The acids are preferably used as such or as anhydrides, but can of course also be used as alkali metal, alkaline earth metal or ammonium salts, such as the sodium, potassium, calcium, ammonium or substituted ammonium salts, in which case the acids can be wholly or partly in salt form.

Suitable monomers (b) which are copolymerizable with the monomers (a) are in particular N-vinylpyrrolidone, N-vinylcaprolactam, N-vinylimidazole, 1-vinyl-2methylimidazole, N-vinylformamide, N-vinyl-N-methylformamide, vinyl acetate, vinyl propionate, styrene, acrylic and methacrylic esters with $C_1$–$C_{30}$-alcohols, hydroxy-$C_2$- to $C_6$-alkyl esters of acrylic acid or methacrylic acid, acrylamide, methacrylamide or mono- or dialkylamides of acrylic acid or methacrylic acid having from 1 to 20 carbon atoms in the alkyl radicals. If monoethylenically unsaturated dicarboxylic anhydrides are used as monomers (a), further particularly suitable monomers (b) include olefins having from 2 to 30 carbon atoms and vinyl alkyl ethers having from 1 to 30 carbon atoms in the alkyl moiety. Here, too, it can be advantageous to use mixtures of components (b).

A further modification of the graft copolymers can be achieved by carrying out the graft polymerization in the presence of monomers of group (c). In this case, the monomer mixtures contain up to 5% by weight of a monomer which contains at least two ethylenically unsaturated, unconjugated double bonds in the molecule. These compounds are customarily employed in copolymerizations as crosslinkers. They can be added to the copolymerizing monomers of group (a) or to the monomer mixtures of (a) and (b). If monomers of group (c) are used at all, they are preferably used in an amount of from 0.05 to 2% by weight. The use of monomers of group (c) during the copolymerization brings about an increase in the K values of the copolymers. Suitable compounds of this kind are for example methylenebisacrylamide, esters of acrylic acid and methacrylic acid with polyhydric alcohols, eg. glycol diacrylate, glycerol triacrylate, glycol dimethacrylate and glycerol trimethacrylate, and also at least diacrylated or dimethacrylated polyols, such as pentaerythritol and glucose. Suitable crosslinkers also include divinylbenzene, divinyldioxane, pentaerythrityl triallyl ether and pentaallylsucrose. The preferred members of this group of compounds are water-soluble monomers, such as glycol diacrylate or glycol diacrylates of polyethylene glycols having a molecular weight of up to 3000.

The polymerization of the monomers (a) and if present (b) and (c) is carried out in the presence of component B. Any vegetable or animal oil is suitable for use as component B. Examples are olive oil, rapeseed oil, soybean oil, sunflower oil, safflower oil, linseed oil, capelin oil and sperm oil.

To prepare the graft copolymers, the monomers (a) and if present (b) and/or (c) are free-radically polymerized in the presence of component B. It can be advantageous here for the effectiveness of the graft polymer being formed to use two or more of the oils specified under B.

The polymerization can be carried out in the presence or in the absence of inert solvents or diluents, the absence being preferred. Examples of inert solvents are aromatic hydrocarbons such as toluene, xylene, o-, m- and p-xylene and isomer mixtures of xylene or ethylbenzene, aliphatic hydrocarbons such as pentane, hexane, heptane, octane, nonane, dodecane, cyclohexane, cyclooctane, methylcyclohexane or mixtures thereof, and gasolene fractions which contain no polymerizable monomers. It is also possible to use chlorinated hydrocarbons such as chloroform, carbon tetrachloride, hexachloroethane, dichloroethane or tetrachloroethane, alcohols such as methanol, ethanol, isopropanol, n-propanol, n-butanol or sec-butanol, tetrahydrofuran, dioxane and mixtures thereof.

It can also be advantageous to emulsify vegetable or animal oils in water with an emulsifier and then to carry out the graft.

The graft polymerization can be carried out continuously or batchwise using in general free-radical initiators.

Preferred free-radical initiators are those which have a half-life of less than 3 hours at the particular polymerization temperature. If the polymerization is first initiated at a low temperature and completed at a higher temperature, it is advantageous to use at least two initiators which decompose at different temperatures, specifically at the start of the polymerization an initiator which decomposes at a low temperature and then for the main polymerization an initiator which decomposes at a higher temperature. It is for example possible to use the following initiators:

40°–60° C.:

acetylcyclohexanesulfonyl peroxide, diacetyl peroxydicarbonate, dicyclohexyl peroxydicarbonate, di-2-ethylhexyl peroxydicarbonate, tert-butyl perneodecanoate, 2,2'-azobis(4-methoxy-2,4-dimethylvaleronitrile), 2,2'-azobis (2-methyl-N-phenylpropionamidine) dihydrochloride, 2,2'-azobis(2-methylpropionamidine) dihydrochloride.

60°–80° C.:

tert-butyl perpivalate, dioctanoyl peroxide, dilauroyl peroxide, 2,2'-azobis(2,4-dimethylvaleronitrile).

80°–100° C.:

dibenzoyl peroxide, tert-butyl permaleate, 2,2'azobis(isobutyronitrile), dimethyl 2,2'-azobisisobutyrate, sodium persulfate, potassium persulfate, ammonium persulfate.

100°–120° C.:

bis(tert-butylperoxy)cyclohexane, tert-butyl peroxyisopropyl carbonate, tert-butyl peracetate, hydrogen peroxide.

>120° C.:

2,2-bis(tert-butylperoxy)butane, dicumyl peroxide, di-tert-amyl peroxide, di-tert-butyl peroxide, p-menthane hydroperoxide, pinane hydroperoxide, cumine hydroperoxide and tert-butyl hydroperoxide or tert-butyl perethylhexanoate.

If the use of the initiators mentioned is complemented with the use of a redox system such as salts or complexes of heavy metals, for example copper, cobalt, manganese, iron, vanadium, cerium, nickel and chromium salts, or organic compounds such as benzoin, dimethylaniline or ascorbic acid, the half-lives of the free-radical initiators mentioned can be reduced. For instance, tert-butyl hydroperoxide can be activated with 5 ppm of copper(II) acetylacetonate to such an extent that polymerization becomes possible at as low a temperature as 100° C. The reducing component of redox catalysts can also be formed for example by compounds such as sodium sulfite, sodium bisulfite, sodium formal-dehydesulfoxylate, and hydrazine. Based on the monomers used in the polymerization, from 0.01 to 20, preferably from 0.05 to 10, % by weight of a polymerization initiator or of a mixture of a plurality of polymerization initiators is used. The redox component used comprises from 0.01 to 5% of the reducing compounds. Heavy metals are used within the range from 0.1 to 100 ppm, preferably from 0.5 to 10 ppm. It is frequently of advantage to use a combination of peroxide and reducing agent and heavy metal as redox catalyst.

The polymerization of the monomers (a) and if used the monomers (b) and/or (c) can also be carried out under the action of ultraviolet radiation in the presence or absence of UV initiators. The photoinitiators/sensitizers customary for this purpose are for example compounds such as benzoin and benzoin ethers, α-methylbenzoin and α-phenylbenzoin. It is also possible to use triplet sensitizers, such as benzyl diketals. Suitable sources of UV radiation are for example not only high-energy UV lamps, such as carbon arc lamps, mercury vapor lamps or xenon lamps, but also low-UV light sources, such as fluorescent tubes with a high blue content.

To prepare polymers having a low K value, the graft polymerization is advantageously carried out in the presence of regulators. Suitable regulators are for example mercapto compounds, such as mercaptoethanol, mercaptopropanol, mercaptobutanol, mercaptoacetic acid, mercaptopropionic acid, butyl mercaptan and dodecyl mercaptan. Suitable regulators also include allyl compounds such as allyl alcohol, aldehydes such as formaldehyde, acetaldehyde, propionaldehyde, n-butyraldehide and isobutyraldehyde, formic acid, ammonium formate, propionic acid, hydrazine sulfate and butenols. If the polymerization is carried out in the presence of regulators, the amount required thereof is from 0.05 to 20% by weight, based on the monomers used in the polymerization.

To prepare colorless or barely colored graft polymers from components (A) and (B), the polymerization is carried out in the presence of water-soluble phosphorus compounds in which the phosphorus has an oxidation number of from 1 to 4, their water-soluble alkali metal or ammonium salts, water-soluble compounds with —PO(OH) groups and/or their water-soluble salts. Preference is given to using phosphorous acid. The contemplated phosphorus compounds are used for reducing the discoloration of the graft copolymers in amounts of from 0.01 to 5% by weight, based on the starting monomers (A). Suitable phosphorus compounds are described in EP-A-0 175 317.

The copolymerization of the components (A) and (B) is customarily carried out in an inert gas atmosphere in the absence of atmospheric oxygen. During the polymerization it is generally customary to ensure thorough mixing of the reactants. In the case of small batches, where safe removal of the heat of polymerization is ensured, the reactants, which are preferably present in an inert diluent, can be copolymerized batchwise by heating the reaction mixture to the polymerization temperature. These temperatures are within the range from 40° to 150° C. To ensure better control of the course of the polymerization reaction, therefore, the monomers (A) are added continuously or batchwise to the polymerizing mixture at such a rate that the graft polymerization is readily controllable within the desired temperature range. Preference is given to adding the monomers of component (A) in a way whereby the polymerization reactor is initially charged with the compounds of component (B) or at least part of the compounds of component (B) together with at least one monomer of group (a) and heating the initial charge to the desired polymerization temperature with stirring. As soon as this temperature is reached, the remaining monomers, if any, of group (a) and, if used, the monomers (b) and optionally (c) and also the initiator and optionally a regulator are added over a period of about 1 to 10, preferably 2 to 8, hours.

It is frequently advantageous initially to pretreat vegetable and animal oils with a free-radical donor in amounts of from 0.1 to 10% and only then to add the monomers (A). For instance, capelin oil can be heated to 150° C. with 1% of di-tert-butyl peroxide under a slow stream of $N_2$ for over 2 h and then be admixed with acrylic acid at 150° C. over 3 h.

After the graft polymerization has ended, the grafted vegetable or animal oil is made into an aqueous dispersion. Dispersing can be carried out in a suitable apparatus using customary emulsifiers such as fatty alcohol ethoxylates, dodecylbenzenesulfonates, dioctyl sulfonsuccinate [sic] or alkylsulfonates. Particular preference is given to emulsifier-free dispersing whereby stable aqueous dispersions are obtained by neutralizing all or some of the carboxyl groups of the graft polymer with alkali metal hydroxide solutions, alkaline earth metal hydroxide solutions, ammonia or amines. These dispersions have a solids content of from 5 to 80%, preferably from 20 to 70%, and can thus be used directly for treating leather and fur skins. The determination of the residue on drying can be carried out for example in a drying cabinet (2 h at 120° C.).

The graft polymers to be used according to the invention make it possible to produce very soft leathers without the addition of conventional fat liquors. The use of these products has no adverse effect on the water-repellent properties of hydrophobicized leathers.

The use of these graft polymers has a very positive influence on the mechanical properties, such as tear strength, and also the lightfastness and thermal yellowing resistance of such leathers. In addition to producing a virtually quantitative exhaustion of the liquor the good fixation in the leather yields great resistance to extractability with solvents or water. This results in washable leathers, ie. leathers which on washing do not lose their properties such as softness, firmness and suppleness, unlike leathers fatliquored with conventional fat liquors.

A further advantage of the aqueous dispersions to be used according to the invention is that they preferably do not contain any additional emulsifiers. This is because it is known that leathers and furs which are to be hydrophobicised and are treated with emulsifier-containing products need to be thereafter subjected to costly processes, eg. aftertreatment with polyvalent metal salts, in order to render the emulsifiers uneffective in the leather or fur skin by fixing them.

The above-described graft polymer dispersions are suitable for treating any conventional tanned hide. Tanned hides are customarily neutralized prior to the treatment. They may already have been dyed prior to the treatment. However, dyeing may also be delayed until after the fatliquoring of the invention.

The tanned hides are advantageously treated with the aqueous dispersions in an aqueous liquor obtainable by diluting the graft polymer dispersions with water at pH 4–10, preferably 5–8, and 20°–60° C. preferably 30°–50° C., for 0.1–5, in particular 0.5–2, h. This treatment may take the form, for example, of drumming. The amount of graft polymer dispersion required is, based on the shaved weight of the leather or the wet weight of the fur skin, from 0.1 to 30, preferably from 1 to 20, % by weight. The liquor length, ie. the percentage weight ratio of treatment liquor to goods, based on the shaved weight of the leather or the wet weight of the fur skin, is customarily from 10 to 1000%, preferably from 30 to 150%, in the case of fur skins from 50 to 500%.

After the treatment with the aqueous liquor the pH of the treatment liquor is adjusted with acids, preferably an organic acid such as formic acid, to pH 3–5, preferably pH 3.5–4.

If customary retanning agents are additionally employed in processing the leather or fur skin, the treatment with the aqueous dispersions to be used according to the invention can be carried out before or after the retanning operation.

The percentages in the Examples are by weight, unless otherwise stated.

EXAMPLES OF PREPARATION

Example 1

In a stirred flask, 100 g of capelin oil and 0.5 g of tert-butyl perethylhexanoate are heated to 150° C. and stirred at 150° C. for 1.5 h under a slow stream of $N_2$. Then 5 g of maleic anhydride and 0.5 g of tert-butyl perethylhexanoate are added, and heating is continued at 150° C. for a further 6 h. The reaction is then cooled down, 300 g of water and 3.8 g of 50% strength sodium hydroxide solution are added, and the mixture is dispersed with an Ultra-Turrax for 10 minutes. The dispersion obtained has a pH of 10.0, a 25% residue on drying and a Brookfield viscosity of 22 mPa s at 23° C. It can be used directly for leather treatment.

Example 2

100 g of capelin oil and 1 g of tert-butyl perethylhexanoate are heated to 150° C. and stirred for 1 h as described in Example 1. Then 10 g of maleic anhydride and 1 g of tert-butyl perethylhexanoate are added and heating is continued at 150° C. for 6 h. After cooling, the batch is diluted with 310 g of water and 7.2 g of 50% strength sodium hydroxide solution and intensively dispersed with an Ultra-Tarrax for 10 minutes. The dispersion obtained has a pH of 8.9, a 25% residue on drying and a Brookfield viscosity of 16 mPa. s at 23° C.

Example 3

108 g of rapeseed oil are heated to 150° C. under a slow stream of $N_2$ as described in Example 1. Then 20 g of acrylic acid (100% strength) and a solution of 1 g of tert-butyl perethylhexanoate in 10 g of rapeseed oil are metered in at 150° C. over 1 h at uniform rates. This is followed by stirring at 150° C. for 2 h, the addition of a further 1 g of tert-butyl perethylhexanoate and further heating at 150° C. for 2 h.

100 g of the graft polymer thus obtained are diluted with 76 g of water and intensively dispersed for 10 minutes. The white viscous dispersion has a pH of 3.5 and a 55.9% residue on drying.

Example 4

Replacing the acrylic acid by methacrylic acid gives a dispersion having similar properties.

Example 5

100 g of rapeseed oil and 1 g of tert-butyl perethylhexanoate are heated at i50° C. under a slow stream of $N_2$ for 1 h as described in Example 1. Then 18 g of maleic anhydride and 1 g of tert-butyl perethylhexanoate are added and the mixture is heated at 150° C. for 6 h. It is then cooled down and 105 g of the product are mixed with 90 g of water and 8 g of 50% strength sodium hydroxide solution and intensively dispersed with an Ultra-Turrax for 10 minutes. The result is a homogeneous, viscous dispersion giving a 52.7% residue on drying and having a pH of 5.5.

Example 6

100 g of capelin oil are heated to 150° C. under a slow stream of nitrogen as in Example 1 and at 150° C. are then admixed over 1 h at uniform rates with 20 g of acrylic acid and with a solution of 1 g of tert-butyl perethylhexanoate in 10 g of capelin oil. This is followed by an additional hour of heating, after which a further 1 g of tert-butyl perethylhexanoate is added and heating is continued for a further 1 h. After cooling, 103 g of the product are admixed with 90 g of water and 9 g of 50% strength sodium hydroxide solution and intensively dispersed with an Ultra-Turrax for 10 minutes. The viscous, homogeneous dispersion has a pH of 7.0 and gives a 49.1% residue on drying.

Example 7

Example 6 was repeated using 20 g of methacrylic acid instead of acrylic acid. 115 g of the resulting graft polymer, 95 g of water and 14 g of 50% strength sodium hydroxide solution are intensively dispersed with an Ultra-Turrax for 10 minutes. The viscous dispersion has a pH of 7.1 and gives a 51.2% residue on drying.

EXAMPLES OF USE

Example 1

Chrome tanned cattlehide leather which had a shaved thickness of 1.8 mm and had been adjusted to a pH of 5.0 was drummed with 15% of the product of Example 1, based on the shaved weight, at 40° C. for 2 h. The total liquor length was 150%. The leather was then dyed with 1% of a conventional anionic aniline dye. It was then adjusted to pH 3.8. It was finally washed, mechanically set out and dried. The leather obtained was very soft, supple, highly filled and uniform in color.

Example 2

Chrome tanned cattlehide leather which had a shaved thickness of 1.8 mm and had been adjusted to a pH of 5.0 and dyed with 0.7% of a conventional anionic aniline dye was drummed with 20% of the product of Example 2, based on the shaved weight, at 40° C. for 1.5 h. Thereafter, the leather was adjusted with formic acid to a pH of 3.6 and finished in a conventional manner. The leather thus obtained was very soft and pliable.

Example 3

Chrome tanned cattlehide leather which had a shaved thickness of 1.8 mm and which had been adjusted to pH 5.0 and dyed with 0.7% of a conventional anionic aniline dye was drummed with 15% of the product of Example 3, based on the shaved weight, at 40° C. for 30 minutes and then further treated with 3% of a conventional synthetic tanning agent for 1 h. The leather was then adjusted with formic acid to pH 3.6 and finished in a conventional manner. The leather thus obtained had a pleasantly soft and pliable feel.

Example 4

The product of Example 4 was used as per the procedure described in Example 3. The leather thus obtained had soft and round hand properties.

Example 5

The product of Example 5 was used as per the procedure described in Example 1. The leather thus obtained had a round, soft hand.

Example 6

The product of Example 6 was used as per the procedure described in Example 1. The result was similar to that of the preceding examples.

Example 7

The product of Example 7 was used as per the procedure described in Example 3. The result was a soft leather having a pleasant hand.

We claim:

1. A method of fatliquoring or filling a tanned leather or fur skin, comprising contacting said leather or fur skin with a water-soluble or water-dispersible graft polymer of an oil selected from the group consisting of vegetable oil, animal oil, and mixture thereof, wherein said graft polymer is prepared by a process comprising radically polymerizing in the presence of at least one of said oils a monomer or monomer mixture comprising:

(a) from 20 to 100% by weight of at least one monoethylenically unsaturated acid selected from the group consisting of monoethylenically unsaturated carboxylic acids, monoethylenically unsaturated carboxylic acid anhydrides, monoethylenically unsaturated sulfonic acids, monoethylenically unsaturated phosphonic acids and alkali metal, alkaline earth metal and ammonium salts thereof;

(b) from 0 to 80% by weight of one or more other monoethylenically unsaturated, copolymerizable monomers; and (c) from 0 to 5% by weight of one or more unsaturated monomers having at least two unconjugated ethylenically unsaturated double bonds, wherein said monomer or monomer mixture and said oil are present in amounts providing a weight ratio of said monomer or monomer mixture to said oil of from 80:20 to 1:99.

2. The method of claim 1, wherein said monoethylenically unsaturated acid is a carboxylic acid or carboxylic acid anhydride.

3. The method of claim 2, wherein said monoethylenically unsaturated acid is selected from the group consisting of acrylic acid, methacrylic acid, maleic acid and maleic anhydride.

4. The method of claim 2, wherein said component (b) is selected from the group consisting of $C_1$–$C_{20}$-alkyl esters of (meth)acrylic acid, $C_1$–$C_{20}$-alkyl esters of maleic acid and (meth) acrylamide.

5. The method of claim 1, wherein said monomer or monomer mixture consists of said component (a).

6. The method of claim 1, wherein said polymerizing is conducted in a self-emulsifying system.

7. The method of claim 1, wherein said ratio of said monomer or monomer mixture to said oil is from 60:40 to 5:95.

8. The method of claim 1, wherein said contacting is conducted in an aqueous dispersion of said graft polymer.

9. The method of claim 8, wherein said aqueous dispersion has a pH of 4–10 and said contacting is conducted at a temperature of 20°–60° C. for a length of time of 0.1–5 h.

10. The method of claim 9, wherein said pH is 5–8, said temperature is 30°–50° C. and said length of time is 0.5–2 h.

11. The method of claim 1, wherein said oil is selected from the group consisting of olive oil, rapeseed oil, soybean oil, sunflower oil, safflower oil, linseed oil, capelin oil and sperm oil.

* * * * *